US007886502B2

(12) United States Patent
Sperry et al.

(10) Patent No.: US 7,886,502 B2
(45) Date of Patent: Feb. 15, 2011

(54) PACKAGING MACHINE

(75) Inventors: Laurence Sperry, Newton, MA (US); Brian A. Murch, Woburn, MA (US); Ross Patterson, Boston, MA (US)

(73) Assignee: Sealed Air Corporation (US), Saddle Brook, NJ (US)

( * ) Notice: Subject to any disclaimer, the term of this patent is extended or adjusted under 35 U.S.C. 154(b) by 67 days.

(21) Appl. No.: 12/124,226

(22) Filed: May 21, 2008

(65) Prior Publication Data

US 2009/0126319 A1 May 21, 2009

Related U.S. Application Data

(62) Division of application No. 11/093,365, filed on Mar. 30, 2005, now Pat. No. 7,386,968.

(51) Int. Cl.
*B65B 57/00* (2006.01)
*B65B 9/02* (2006.01)

(52) U.S. Cl. ..... 53/55; 53/553

(58) Field of Classification Search ..... 53/147, 53/55–58, 74, 493, 495, 496, 498, 553, 555
See application file for complete search history.

(56) References Cited

U.S. PATENT DOCUMENTS

| | | | |
|---|---|---|---|
| 2,309,621 A | 2/1943 | Allat | |
| 2,340,260 A | 1/1944 | Clunan | |
| 2,525,651 A | 10/1950 | Clunan | |
| 2,597,042 A | 5/1952 | Stokes et al. | |
| 2,639,567 A | 5/1953 | Murdoch et al. | |
| 3,432,981 A | 3/1969 | Minten | |
| 3,432,988 A | 3/1969 | Minten | |
| 3,453,169 A | 7/1969 | Buck et al. | |
| 3,503,175 A * | 3/1970 | Marasso et al. | 53/553 |

(Continued)

FOREIGN PATENT DOCUMENTS

| | | |
|---|---|---|
| EP | 0 311 213 | 4/1989 |

(Continued)

OTHER PUBLICATIONS

European Search Report; European Application No. EP 03 25 5586; Date Completed Dec. 11, 2003.

(Continued)

*Primary Examiner*—Stephen F Gerrity
(74) *Attorney, Agent, or Firm*—Alston & Bird LLP

(57) ABSTRACT

A packaging method and apparatus wherein each product is packaged by enveloping the product in flexible packaging material. A programmed microprocessor calculates the length of flexible packaging material needed to package the product based on the physical dimensions of the product, calculates the weight of the flexible packaging material needed, and calculates a total package weight as the sum of the weight of the product and the calculated weight of the flexible packaging material. A printer prints information specific to the product that is being packaged onto a label that is then affixed to the flexible packaging material prior to the product being packaged. The information can be a function of the package weight, and the calculated total package weight can be communicated from the microprocessor to the printer. Finally, the product is packaged in the flexible packaging material having the label already affixed thereto.

5 Claims, 6 Drawing Sheets

U.S. PATENT DOCUMENTS

| | | | | | |
|---|---|---|---|---|---|
| 3,552,088 | A | | 1/1971 | Niwa | |
| 3,579,957 | A | * | 5/1971 | Mills et al. | 53/573 |
| 3,769,778 | A | * | 11/1973 | Nordqvist | 53/553 |
| 3,783,577 | A | * | 1/1974 | Knutson et al. | 53/74 |
| 3,991,540 | A | | 11/1976 | Ballestrazzi et al. | |
| RE29,362 | E | * | 8/1977 | Reid | 53/555 |
| 4,041,674 | A | * | 8/1977 | Reid | 53/496 |
| 4,064,792 | A | | 12/1977 | Gess | |
| 4,074,505 | A | | 2/1978 | Keren et al. | |
| 4,085,560 | A | | 4/1978 | McClosky | |
| 4,124,697 | A | * | 11/1978 | Whelan | 423/580.1 |
| 4,319,443 | A | | 3/1982 | Watts, Jr. | |
| 4,369,613 | A | | 1/1983 | Gess | |
| 4,415,048 | A | | 11/1983 | Teraoka | |
| 4,458,470 | A | | 7/1984 | Fine | |
| 4,466,228 | A | | 8/1984 | Gess | |
| 4,505,092 | A | * | 3/1985 | Bowers et al. | 53/504 |
| 4,548,024 | A | | 10/1985 | Fine | |
| 4,601,157 | A | | 7/1986 | Adelman | |
| 4,684,025 | A | | 8/1987 | Copland et al. | |
| 4,705,588 | A | | 11/1987 | Treiber | |
| 4,807,420 | A | * | 2/1989 | Barker | 53/550 |
| 4,905,457 | A | | 3/1990 | Bene | |
| 4,964,263 | A | | 10/1990 | Ballestrazzi et al. | |
| 5,057,169 | A | | 10/1991 | Adelman | |
| 5,165,221 | A | | 11/1992 | Udelson et al. | |
| 5,199,247 | A | | 4/1993 | Björkman et al. | |
| 5,269,122 | A | | 12/1993 | Reichental et al. | |
| 5,419,425 | A | | 5/1995 | Goater | |
| 5,443,150 | A | * | 8/1995 | Buchko | 198/463.3 |
| 5,444,964 | A | | 8/1995 | Hanagata | |
| 5,704,481 | A | | 1/1998 | Lutz | |
| 5,956,931 | A | | 9/1999 | Stork | |
| 5,966,908 | A | | 10/1999 | Philipp et al. | |
| 6,145,283 | A | | 11/2000 | Noordenbos et al. | |
| 6,209,708 | B1 | * | 4/2001 | Philipp et al. | 198/465.1 |
| 6,971,221 | B2 | * | 12/2005 | Sperry et al. | 53/450 |
| 7,331,153 | B1 | * | 2/2008 | Sperry et al. | 53/553 |
| 2002/0124529 | A1 | | 9/2002 | van der Lely | |
| 2003/0046905 | A1 | * | 3/2003 | Kaechele et al. | 53/459 |

FOREIGN PATENT DOCUMENTS

| | | | |
|---|---|---|---|
| EP | 0 631 936 | A1 | 1/1995 |
| EP | 0 699 583 | A1 | 3/1996 |
| EP | 1 396 428 | | 3/2004 |
| GB | 1 053 915 | | 1/1967 |
| GB | 1 206 163 | | 9/1970 |
| GB | 2 253 385 | A | 9/1992 |
| GB | 2 403 198 | | 12/2004 |
| JP | 2000-142634 | A | 5/2000 |
| WO | WO 94/06689 | | 3/1994 |

OTHER PUBLICATIONS

European Search Report; European Application No. EP 03 25 5586; Date Completed Mar. 31, 2004.

The European Search Report for European Application No. 06251737.0; Filed Mar. 29, 2006; Search Completed Jun. 7, 2006.

European Search Report for Application No. EP 10 00 1872 mailed May 4, 2010.

European Search Report for Application No. EP 10 00 1873 mailed Apr. 28, 2010.

* cited by examiner

PACKAGING MACHINE

CROSS-REFERENCE TO RELATED APPLICATION

This application is a divisional of U.S. patent application Ser. No. 11/093,365 filed on Mar. 30, 2005, now U.S. Pat. No. 7,386,968, the entire disclosure of which is incorporated herein by reference.

BACKGROUND OF THE INVENTION

The present invention relates to a method and apparatus for packaging products for shipping.

Mail-order companies and other organizations that deliver products by mail or courier are continually striving to improve the efficiency of the processes of packaging products and getting them ready for shipment, which generally includes labeling (i.e., affixing a label on each package indicating the address of the recipient), and franking (i.e., putting the correct postage on each package). In many cases, even if the products are packaged by an automated packaging machine, the processes of labeling and franking are performed at least in part by hand.

For instance, many small- to medium-volume shippers still manually weigh each package after the packages are produced. A label is then printed, and a worker manually applies the label to the package. Not only is this procedure inefficient, but it has potential for errors, such as applying the wrong label to a package.

BRIEF SUMMARY OF THE INVENTION

The present invention addresses the above needs and achieves other advantages. In one aspect of the invention, there is provided a packaging method and apparatus that automates the process of packaging products and that labels the packages during the process of producing the packages. In some embodiments, the weight of each package is automatically determined so that no post-production weighing procedure is required.

A method in accordance with one embodiment of the invention is suitable for packaging products of varying weights and physical dimensions for shipping, wherein each product is packaged by enveloping the product in flexible packaging material of predetermined width and predetermined weight per unit area (or, equivalently, predetermined weight per unit length). The method includes using a programmed microprocessor to calculate the length of flexible packaging material needed to package the product, based on the physical dimensions of the product, and to calculate the weight of the flexible packaging material needed to package the product based on the length, the predetermined width, and the predetermined weight per unit area of the flexible packaging material. The microprocessor then calculates a total package weight as the sum of the weight of the product and the calculated weight of the flexible packaging material.

The method further includes using a printer to print information onto a label that is then affixed to the flexible packaging material, wherein the label is specific to the product that is being packaged. In some embodiments, the information can be a function of the package weight (e.g., the information can include the amount of postage payable for shipping the package, which depends on package weight). Accordingly, the calculated total package weight can be communicated from the microprocessor to the printer. Finally, the product is packaged in the flexible packaging material having the label already affixed thereto.

In preferred embodiments, first and second rolls of the flexible packaging material are provided and an upper web is drawn from one of the rolls and a lower web is drawn from the other roll, each of the upper and lower webs being advanced by a web drive system. The product is disposed between the upper and lower webs and the webs with the product therebetween are advanced by the web drive system through a nip to adhere the webs to each other and envelop the product therebetween. The lower web upstream of the nip is generally horizontal for receiving the product thereon.

The lower web upstream of the nip can be advanced over a scale for weighing the product. The scale determines the weight of the product and communicates the weight to the microprocessor. Alternatively, the weight of each product can be determined by scanning a product code on the product or on a packing slip associated with the product and consulting a database that includes information such as product weight corresponding to each of various product codes stored in the database.

In one embodiment, the method includes the step of using a product length detector to determine the length of the product disposed on the lower web. The microprocessor calculates the length of each of the upper and lower webs of flexible packaging material needed for packaging the product based in part on the length of the product. The length of web material needed can also depend on the product height, which can be either measured by a height detector or known in advance (e.g., by consulting the database based on a scanned product code) and input to the microprocessor.

When a scale is used for weighing products, the method can be implemented in a batch mode wherein a first product of a batch of identical products is weighed by the scale and the weight is determined for the first product. The first product is then packaged as previously described. Thereafter, the weighing step is skipped and the microprocessor uses the same weight for each subsequent product of the batch.

In preferred embodiments of the invention, an automated label applicator affixes the label to the flexible packaging material. The method includes verifying whether the label was affixed by the label applicator, and the web drive system advances the webs and the product through the nip only after it has been verified that the label was affixed.

The invention in another aspect provides a packaging method and apparatus wherein an extendable and retractable infeed gate is disposed upstream of the nip through which the product is advanced between the webs of flexible packaging material. The infeed gate is extended into a blocking position proximate the lower web so that a product to be packaged can be placed onto the lower web and abutted against the infeed gate. In this manner, the leading edge of the product is positioned at a known location along the longitudinal direction (i.e., the product length direction) in which the product is advanced into the nip. The infeed gate thus facilitates automatic detection of the product length using a product length detector. The infeed gate is then retracted to its unblocking position such that the webs and product can be advanced through the nip.

A packaging apparatus in accordance with another embodiment of the invention, which facilitates labeling of the packaging material prior to the packaging operation, comprises a pair of opposed rollers forming a nip therebetween, a web guide system for guiding a pair of opposing upper and lower webs of flexible packaging material into the nip, an infeed bed located upstream of the nip, the lower web being supported by the infeed bed such that a product to be packaged can be placed onto the lower web on the infeed bed and advanced along with the lower web in a longitudinal direction into the nip, and a generally planar labeling support member spaced upstream of the nip. The web guide system includes upper web guides structured and arranged to guide the upper web to travel along a surface of the labeling support member such that the upper web is supported by the labeling support member and an upper surface of the upper web is accessible for affixing an adhesive label thereon. The affixing can be accomplished manually or by using an automated label applicator.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
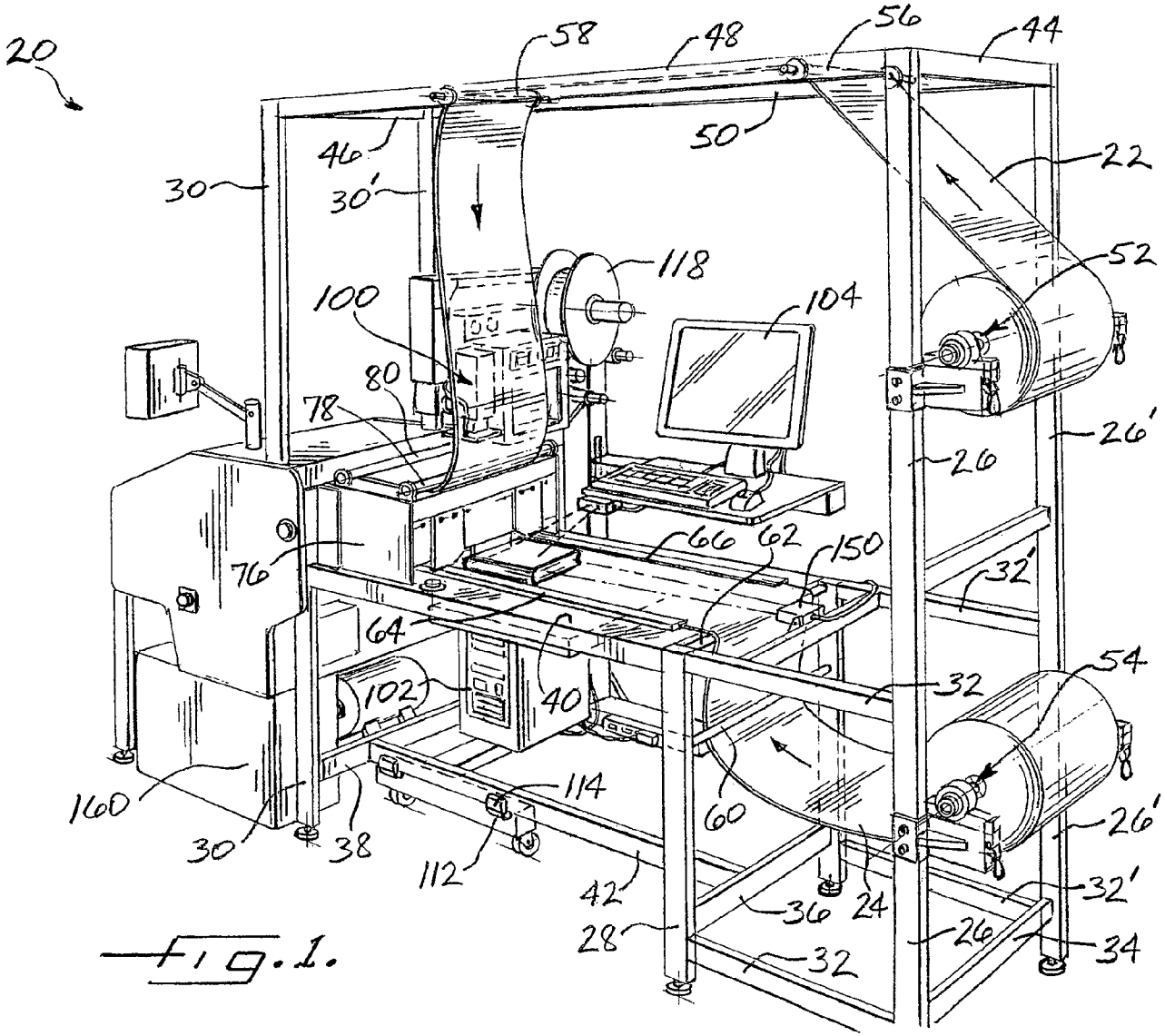
FIG. 1 is a perspective view of a packaging machine in accordance with one embodiment of the invention.

A packaging apparatus 20 in accordance with one embodiment of the invention is shown in FIG. 1. The apparatus 20 is of the dual-web type for advancing a first or upper web 22 and a second or lower web 24 in generally parallel opposing relation with an object disposed between the webs and sealing the webs together to capture the object therebetween. The apparatus includes a main frame having a base formed by a plurality of spaced vertical support columns 26, 28, 30, on one side of a longitudinal axis of the apparatus, and a corresponding plurality of spaced vertical support columns 26', 28', 30' (column 30' not visible in FIG. 1) on the opposite side of the longitudinal axis. Upper and lower longitudinal members 32 are rigidly connected between support columns 26 and 28 and between support columns 28 and 30, and similar longitudinal members 32' are rigidly connected between columns 26' and 28' and between columns 28' and 30'. A lower transverse member 34 is rigidly connected between the support columns 26 and 26', a lower transverse member 36 is rigidly connected between the support columns 28 and 28', and a lower transverse member 38 is rigidly connected between the support columns 30 and 30'. A generally planar infeed bed 40 is rigidly connected between the longitudinal members 32, 32'. A lower longitudinal member 42 is rigidly connected between the lower transverse members 36 and 38.

The main frame also includes a superstructure that extends up from the base and above the infeed bed 40. The superstructure is formed by upward extensions of the support columns 26, 26', 28, 28', 30, and 30'. An upper transverse member 44 is rigidly connected between the upper ends of the columns 26 and 26', and an upper transverse member 46 is rigidly connected between the upper ends of the columns 30 and 30'. An upper longitudinal member 48 is rigidly connected between the upper ends of the columns 26 and 30, and an upper longitudinal member 50 is rigidly connected between the upper ends of the columns 26' and 30'.

Upstream columns 26 and 26' support web mounts 52, 54 that respectively support supply rolls of the webs 22, 24 in a rotatable manner. The upper web 22 is drawn from its supply roll and advanced over a guide 56 supported between the longitudinal members 48, 50, then over a guide 58 supported between the longitudinal members 48, 50 and spaced longitudinally downstream from the first guide 56, and then downward for further handling as described in detail below. The lower web 24 is drawn from its supply roll and advanced under a lower guide 60 supported between columns 28, 28', then over an upper guide 62 supported between columns 28, 28', then onto the upper surface of the infeed bed 40. The infeed bed supports a pair of web edge guides 64, 66 that extend parallel to the longitudinal axis of the machine and are spaced apart by a distance about equal to the width of the lower web 24. The edge guides capture the opposite edges of the web 24 between the infeed bed and the guides and thereby hold the lower web flat on the infeed bed and substantially prevent transverse movement of the web, while allowing the web to freely move in the longitudinal direction. A product P to be packaged is placed upon the lower web 24 on the infeed bed, as further described below.

Figure 4:
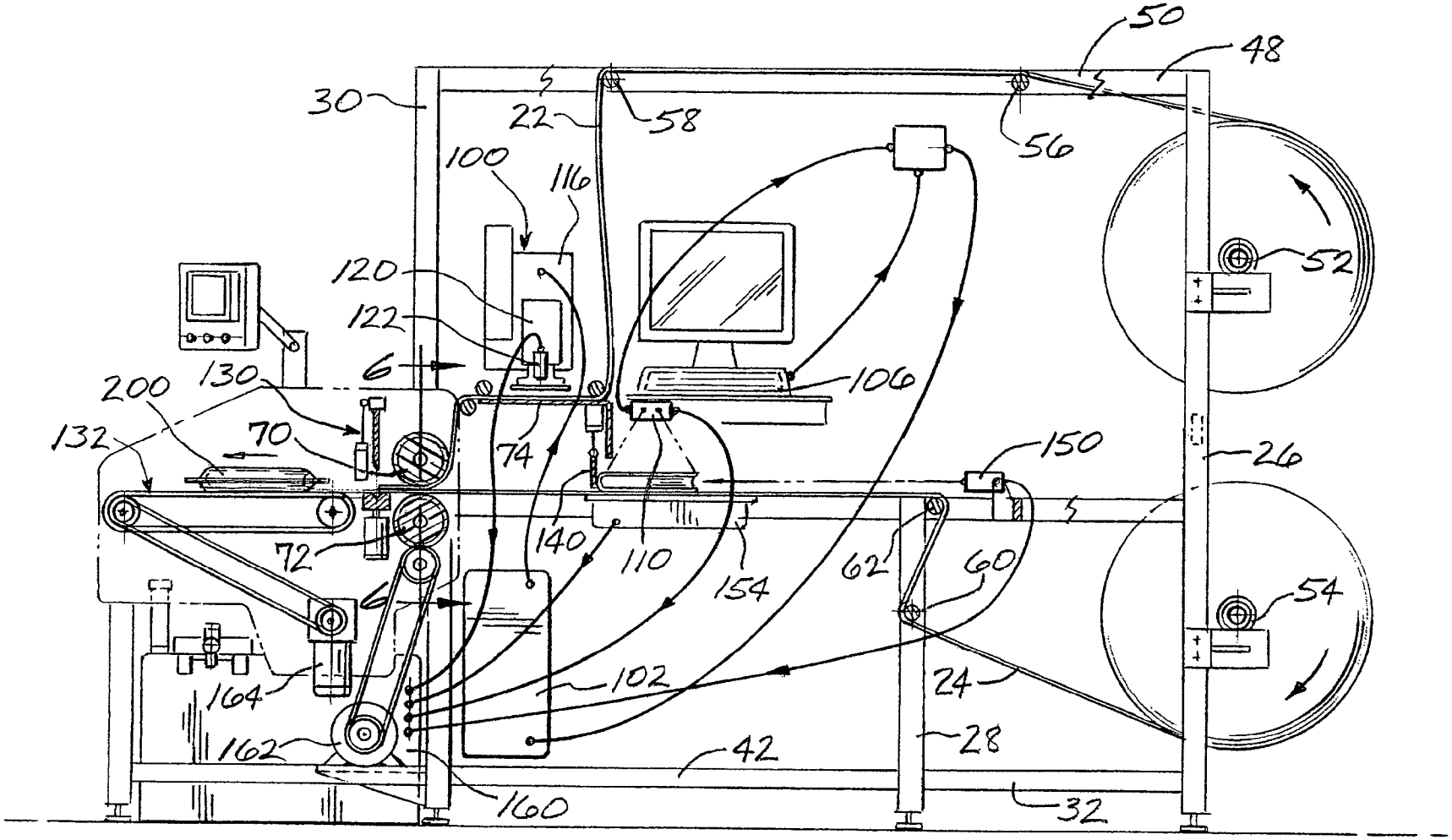
FIG. 4 is a diagrammatic view of a packaging machine in accordance with an embodiment of the invention, showing the interconnections of various components of the machine.
Figure 6:
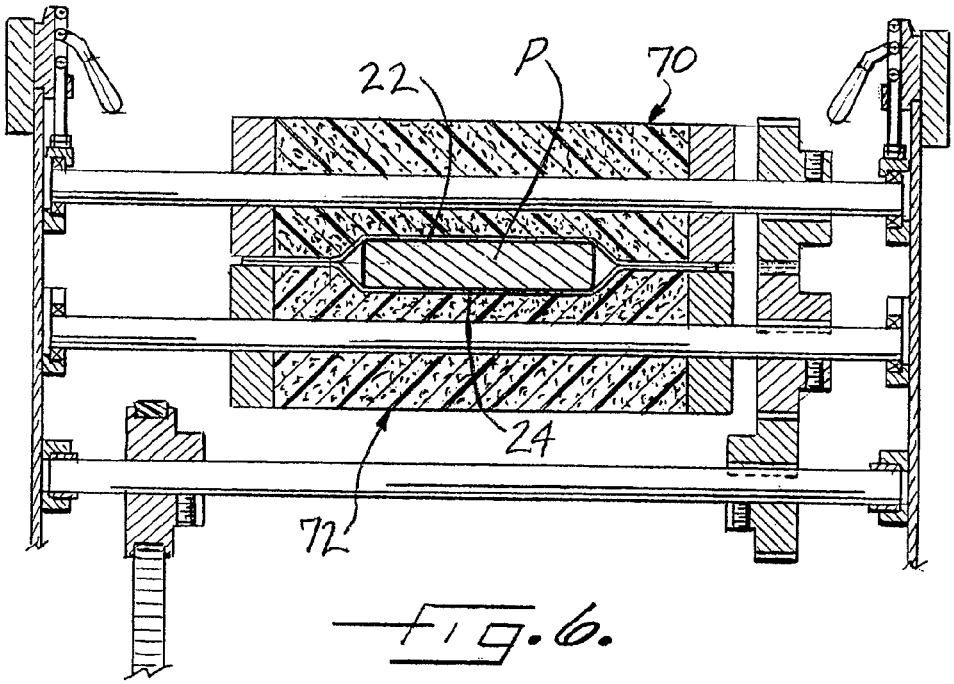
FIG. 6 is a cross-sectional view along line 6-6 in FIG. 1.

With reference to FIGS. 1, 4, and 6, the apparatus includes a pair of rollers 70, 72 that are rotatably mounted in the main frame at a downstream end thereof. The rollers 70, 72 form a nip through which the webs 22, 24 are advanced with the product P disposed therebetween. Advantageously, one or both of the rollers 70, 72 comprises a resiliently deformable material at least over a medial portion of the roller's length, such that the passage of the product through the nip deforms the roller(s) and the restoring force of the resiliently deformable material presses the webs 22, 24 toward each other so that the web conform closely to the product. The webs advantageously have cold seal or cohesive material on their facing surfaces such that the application of pressure by the rollers 70, 72 causes the webs to adhere to each other but not to the product. The end portions of each of the rollers 70, 72 advantageously comprise a generally non-deformable material for firmly gripping the opposite edge portions of the webs 22, 24, and the rollers advantageously are rotatably driven for advancing the webs through the apparatus, thus comprising a web drive system. Alternatively, a separate web drive system can be employed if desired.

With reference to FIGS. 1 and 4, at a downstream end of the infeed bed 40, an upper web support plate 74 is mounted between a pair of spaced end plates 76, forming a housing that rests atop the base of the main frame. This housing preferably is pivotable relative to the main frame about hinges (not shown) located at the upper downstream corner of the housing, for access to internal parts of the machine when required for maintenance and the like. The upper web support plate 74 is spaced vertically above the level of the infeed bed. The upper web is advanced beneath a pair of longitudinally spaced web guides 78, 80 supported atop the end plates 76, such that the upper web passes along the upper surface of the support plate 74. As further described below, the support plate 74 provides support for the upper web 22 so that an adhesive label can be affixed onto the web either by hand or, in some embodiments as described below, by a labeling unit.

Figure 2:
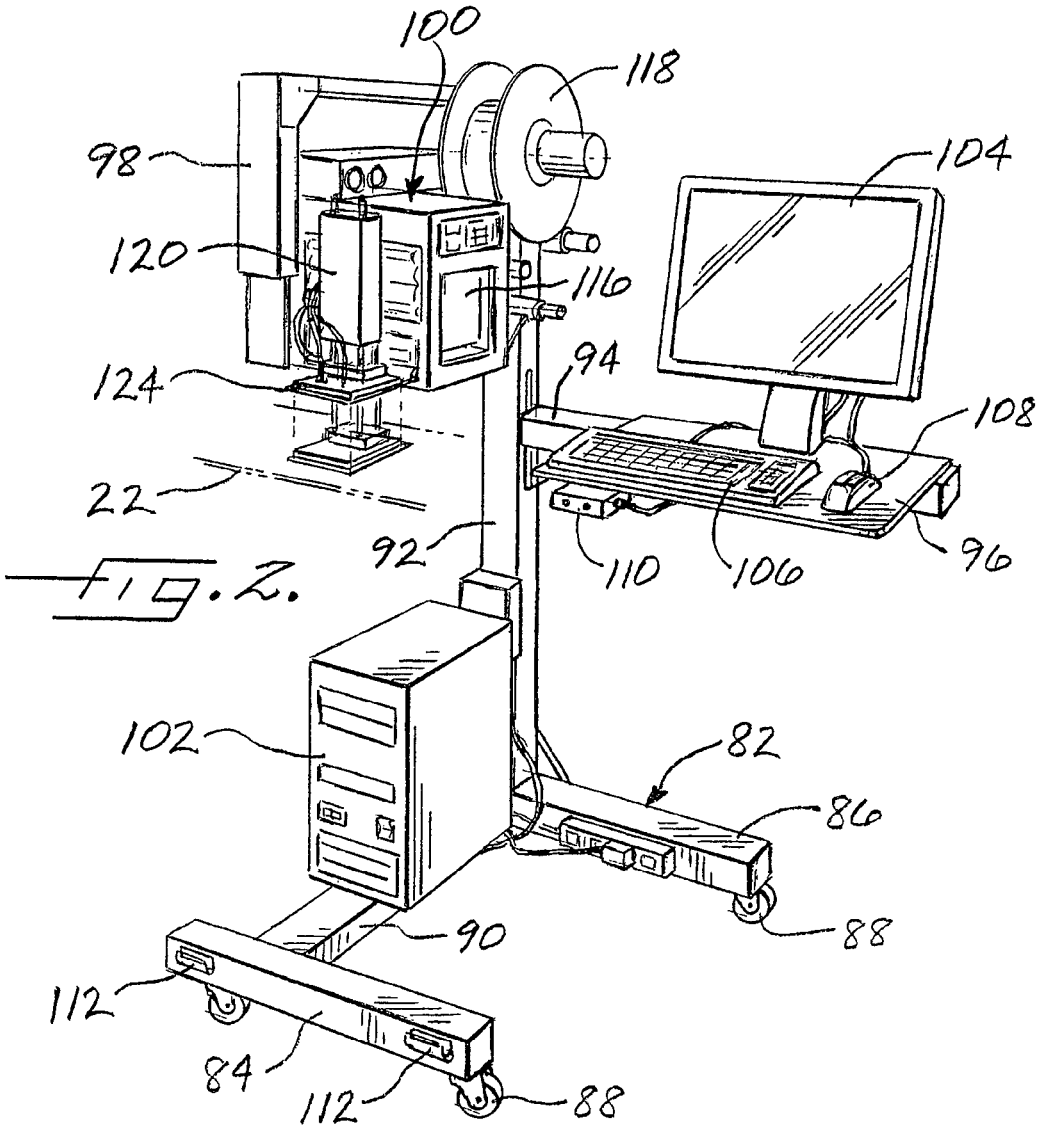
FIG. 2 is a perspective view of a module frame supporting various equipment in accordance with another embodiment of the invention.

The apparatus 20 in the illustrated embodiment also includes a module frame 82, best seen in FIG. 2. The module frame comprises a stand-alone module that is configured to support various components that tend to be specific to a particular user of the packaging apparatus, and that is configured to releasably dock with the main frame of the apparatus so that the components are positioned properly for operation during the packaging process. The module frame comprises a base formed by a pair of spaced longitudinal members 84, 86 each of which has wheels 88 such as caster wheels or the like for rolling the module frame along a floor, and a transverse member 90 rigidly connected between the longitudinal members 84, 86. A vertical support column 92 extends upwardly from the base. A longitudinal support member 94 is rigidly connected to the column 92 in cantilever fashion and supports a generally horizontal platform 96. The upper end portion of the support column 92 supports a fixture 98 configured to mount a labeling unit 100. A customer terminal 102, comprising a microprocessor and memory (e.g., a personal computer), is mounted on the transverse member 90 of the module frame. A visual display monitor 104, a keyboard 106, and a mouse 108 are supported by the platform 96 and are connected to the customer terminal 102. A product scanner 110 is also supported by the platform 96. These components and their operation are further described below.

The module frame 82 includes releasable fastening devices 112 mounted on the longitudinal base member 84. The fastening devices 112 are configured to releasably engage corresponding fastening devices 114 (FIG. 1) on the longitudinal member 42 of the main frame of the apparatus so as to dock the module frame with the main frame.

The labeling unit 100 comprises a printer 116 operable to print on adhesive labels that are preferably in the form of a continuous web of release liner material with the labels releasably adhered to the liner and spaced along its length direction. A roll 118 of the adhesive labels is mounted on the module frame adjacent the labeling unit. The label web is advanced through the printer, the printer prints on each label, and then the label is separated from the release liner for application to the upper web 22. The labeling unit includes an automated label applicator 120 that receives the label from the printer. A sensor 122 (FIG. 4) detects when a label has been received by the applicator, as further described below. The label applicator includes a suitable mechanism for holding onto the upper, non-adhesive side of the label, such as a vacuum-operated tamp head 124. The tamp head 124 is movable by a suitable pneumatic cylinder or the like between an upper position and a lower position; in the lower position, the adhesive label held by the tamp head is pressed against the upper web 22 supported on the support plate 74, thereby affixing the label to the web. There are a variety of commercially available labeling units that can be used in the practice of the invention, and the invention is not limited to any particular type. A suitable labeling unit is the Model 250 print and apply labeling system available from RSI ID Technologies of Chula Vista, Calif.; the system includes a Zebra thermal-transfer printer. Other types of printing devices can be used, including ink jet, laser jet, and the like. Furthermore, it is within the scope of the invention to print directly onto the flexible packaging material rather than onto a separate label.

With primary reference to FIG. 4, after the upper web 22 has had a label affixed to it, the upper web and lower web are advanced by the web drive system to pass through the nip between the rollers 70, 72, along with the product P supported on the lower web 24. The distance traveled by the upper web between the label application station and the nip is designed in relation to the distance traveled by the product from its initial location on the infeed bed to the nip so that the label on the upper web is generally centered on a package formed to envelope the product. After the product passes through the nip, a cutoff device 130 severs the web material at a location spaced downstream from the trailing edge of the product to produce a completed package. A package outfeed conveyor 132 receives the package and conveys it to another location such as into a bin (not shown).

Figure 5:
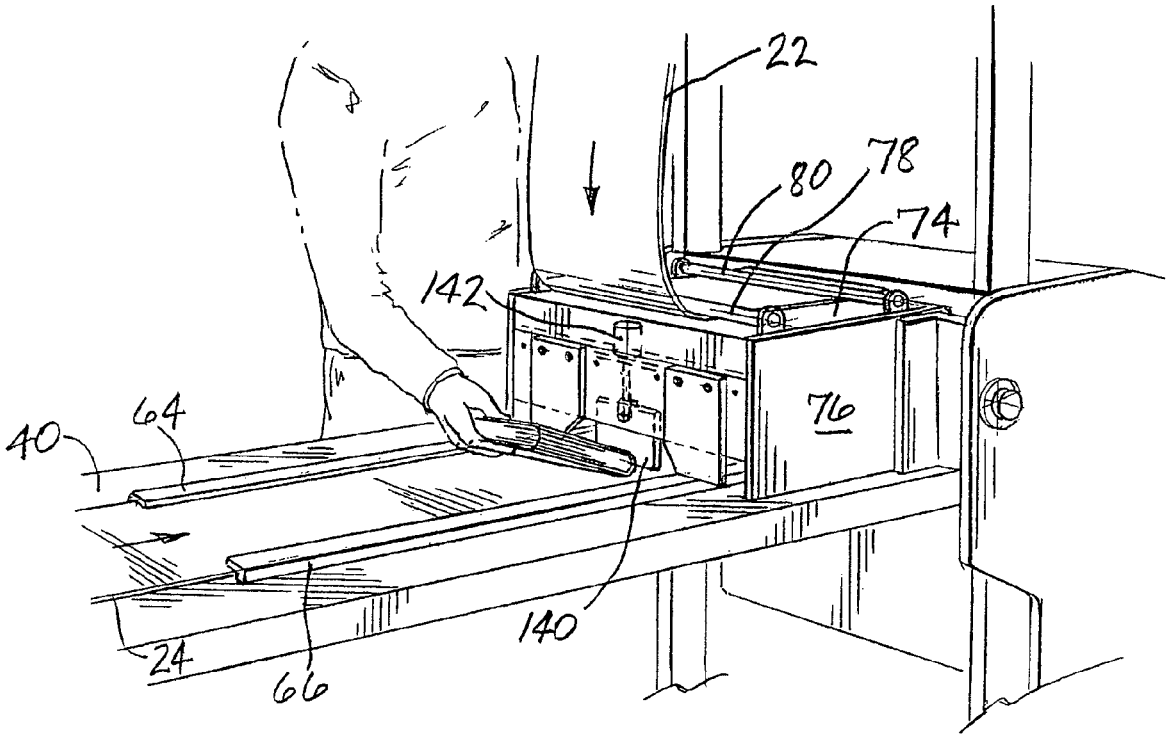
FIG. 5 is a partial perspective view of a packaging machine in accordance with an embodiment of the invention, showing operation of an infeed gate.

With reference to FIGS. 4 and 5, the apparatus 20 advantageously includes an infeed gate 140 suitably mounted (such as below the upper web support plate 74) in a position upstream of the nip defined by the rollers 70, 72. The infeed gate is connected to an actuator 142, such as a pneumatic cylinder or the like, operable to move the infeed gate between a blocking position wherein the lower edge of the gate abuts or nearly abuts the lower web 24 on the infeed bed 40 and an unblocking position wherein the lower edge of the gate is spaced above the lower web by a distance exceeding a maximum height of the products to be packaged such that the products can pass beneath the gate. Thus, when a package is to be formed, the infeed gate is lowered to the blocking position and the product is placed on the lower web with the leading edge of the product abutting the gate. This ensures that the leading edge of the product is in a consistent, repeatable location with respect to the nip.

With reference to FIGS. 1 and 4, the apparatus 20 also includes a product length detector 150 for measuring the length of a product disposed on the lower web 24 on the infeed bed 40. The product length detector can comprise various types of devices, including but not limited to an optical distance-measuring device such as a laser distance-measuring device. The product length detector is preferably mounted adjacent an upstream end of the infeed bed 40 and is positioned and aimed at the trailing edge of the product disposed on the lower web. By measuring the distance from the detector to the trailing edge, and with knowledge of the distance from the detector to the leading edge (e.g., when the infeed gate 140 is employed and the leading edge is abutted against the gate), the length of the product between the leading and trailing edges can be determined.

With reference to FIG. 4, the apparatus 20 in some embodiments can include a scale 154 embedded in the infeed bed 40 in such a manner that the lower web 24 passes over the scale and the weight of a product disposed on the lower web is entirely supported by the scale. For example, the infeed bed can have an aperture therein and the scale can be mounted beneath the aperture such that the upper surface of the scale is flush with the upper surface of the infeed bed. The total weight supported by the scale comprises the product plus a portion of the lower web; accordingly, a tare measurement of the lower web alone can be subtracted from the total weight to determine the product weight. The product weight is one component of the total weight of a package enclosing the product. The total package weight is determined in a manner described below.

As noted, the apparatus includes a product scanner 110. The product scanner is positioned above the infeed bed near the infeed gate 140 so that a product placed on the lower web against the gate can be scanned to detect a product code on the product or on an item that is packaged along with the product, such as a packing slip. The product code can be in the form of a bar code the encodes a universal product code or the like. The scanner can comprise a bar code reader. Based on the product code, information about the identity of the product and its characteristics (e.g., product weight, product length, product height, etc.) and other information associated with the product can be determined. Such information can be stored in the memory of the customer terminal 102, for instance.

The apparatus 20 includes a controller 160 comprising a microprocessor and memory (e.g., a personal computer or the like). The controller 160 is programmed to control the various motors and actuators of the apparatus 20 that effect movement of the moving parts such that the movements are properly synchronized with respect to one another and so that packages are properly made and labeled. FIG. 4 shows the interconnections between the controller 160 and certain components of the apparatus; in addition to the connections shown in FIG. 4, it will be understood that the controller 160 is also connected to the motor 162 that drives the nip rollers 70, 72, to the cutoff device 130, to the motor 164 that drives the outfeed conveyor 132, and to the actuator 142 for the infeed gate 140. As depicted in FIG. 4, the controller 160 is connected to the product length detector 150 and receives a signal therefrom. The detector 150 can be calibrated so that its signal is directly indicative of the product length; alternatively, the signal can be indicative of the distance from the detector to the trailing edge of the product, and the microprocessor of the controller 160 can be programmed to calculate the product length by subtracting that distance from a predetermined distance between the detector and the infeed gate 140 stored in the memory of the controller.

The controller 160 is also connected to the product scanner 110 for receiving a signal therefrom indicative of the product code read by the scanner. The memory of the controller 160 can store a database that includes product information correlated with product codes, so that based on the product code indicated by the signal from the scanner 110, information about the product can be retrieved from the database. The information can include, for example, the height of the product. The product height is important because the length of the packaging material webs 22, 24 required for packaging a product depends not only on the product length but also on the product height. In particular, the length of the fin (i.e., the portion of web material that extends upstream of the product's leading edge and the portion that extends downstream of the product's trailing edge) advantageously depends on product height; for instance, the fin length can be a multiple of the product height such that the greater the product height, the greater the fin length. Thus, product height must be known. This can be accomplished either by storing the predetermined product height in the database of the controller 160 and accessing it based on the scanned product code, or by using a product height detector. As an example, the product height detector can be incorporated into or mounted alongside the scanner 110, or in another suitable location.

The microprocessor of the controller 160 advantageously is programmed to calculate the length of the webs 22, 24 needed for packaging the product scanned by the scanner 110. The required length, as noted, depends on the product length and product height. The microprocessor is also programmed to calculate the weight of the required length of the webs 22, 24 based on the web length and a predetermined weight per unit length of the web material stored in the memory of the controller; thus, the weight of each web is equal to the length multiplied by the weight per unit length. Alternatively, the weight of each web can be calculated by multiplying the length by a predetermined weight per unit area or basis weight and multiplying that product by a predetermined width of the web material.

The controller 160 is connected to the scale 154, when a scale is present. The scale provides a signal indicative of the weight exerted on the scale and communicates the signal to the controller 160. As previously noted, the scale advantageously is tared to effectively subtract the weight of the lower web (and taring preferably is performed before each product is weighed), such that the signal from the scale is directly indicative of the product weight. The microprocessor of the controller calculates the total package weight as the sum of the product and web material weights.

The controller 160 is also connected to the labeling unit 100 for controlling its operation. As previously described, the labeling unit includes a sensor 122 for detecting when a label has been received at the tamp head 124 of the label applicator 120. The signal from the sensor 122 is received by the controller 160. The microprocessor of the controller is programmed so that the web drive system is activated to advance the webs and product through the nip if and only if the sensor 122 confirms that a label was received at the tamp head, which gives a positive confirmation (once the tamp head is lowered against the upper web) that a label has been affixed to the upper web 22. Preferably, the label is printed and affixed only if the product code has been successfully scanned by the scanner 110. Thus, the invention ensures that packages are made only if a good scan has been accomplished and a label has been printed and affixed.

The operation of the apparatus 20 is now explained with primary reference to FIGS. 1 and 4. Rolls of upper and lower webs 22, 24 are mounted in the web mounts 52, 54, respectively. The upper web 22 is threaded through the machine by advancing the web over the guides 56, 58 and then downward and under the guides 78, 80, and then through the nip between rollers 70, 72. The lower web 24 is threaded by advancing the web under guide 60, over guide 62, through the web edge guides 64, 66 and through the nip. To begin a packaging sequence, a product P is placed on the lower web 24 against the infeed gate 140, which is normally down in its blocking position unless the controller commands its actuator to raise the gate. A cycle start button (not shown) is pressed, which causes the controller 160 to execute a series of operations as follows: The controller 160 causes the product scanner 110 to scan the product code, and the signal from the scanner is sent to the customer terminal 102, which, based on the product code, accesses its database and retrieves information about the scanned product that will be used, among other things, for generating information to be printed on a label. The controller 160 also receives feedback from the scanner 110 to confirm the product was scanned. Next, the scale 154 is tared and the product is weighed, and the product weight is stored in the memory of the controller 160. The product length detector 150 measures the distance to the product's trailing edge and the microprocessor of the controller 160 calculates the product length based on that measured distance and the known distance to the infeed gate 140 where the product's leading edge is located. The microprocessor then calculates the length of the webs 22, 24 required for the package based on the product length, and advantageously also based on the product height, which can be either measured with a height detector or stored in a database in the customer's terminal (or, alternatively, in the memory of the controller 160). Based on the web length, the microprocessor of the controller 160 then calculates the material weight using a formula such as web length multiplied by weight per unit length or the like. The total package weight is then calculated as the sum of the product weight and the web material weight, and the package weight is stored in the memory of the controller 160 and/or is communicated to the customer terminal 102 where it is stored.

The customer terminal 102 then can generate information to be printed on a packing slip for packaging along with the product, and that information can be sent to a packing slip printer (not shown), if desired. The customer terminal 102 also sends the label information to the printer 116 of the labeling unit 100, which prints a label and sends the label to the label applicator 120. The label sensor 122 monitors to detect when the label is received by the tamp head 124 of the applicator, and the applicator then affixes the label onto the upper web 24 on the support plate 74. Finally, the controller 160 causes the web drive system motor 162 to drive the rollers 70, 72 to advance the webs 22, 24 and the product P through the nip to produce a package 200, which is cut off by the cutoff device 130 and conveyed by the outfeed conveyor 132 to the machine discharge. The process generally as described above is repeated for each subsequent package. The microprocessor of the controller 160 is programmed to alternately advance the webs by an index distance (i.e., the required length of the webs for packaging each product) and bring the webs to a stop, with the index distance being determined by the controller for each product based on the length of the product indicated by the product length detector, as previously described.

Figure 3:
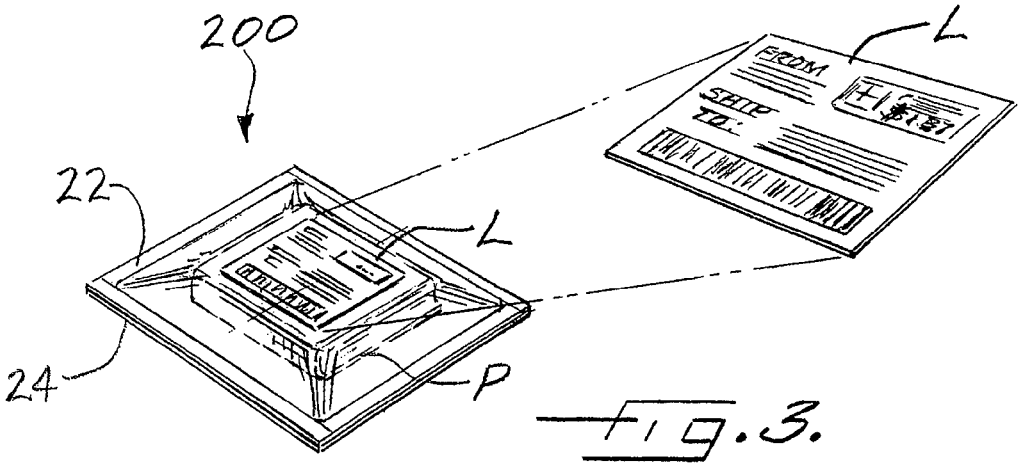
FIG. 3 is a perspective view of a package, also showing a label affixed thereto.

FIG. 3 depicts a package 200 produced in accordance with the invention. The product P is enclosed between the upper web 22 and lower web 24, which are sealed to each other at marginal regions of the web surrounding the product. A label L is affixed to the upper web 22. As shown, the label is printed with text and/or symbols embodying information such as the recipient's name and address, sender's name and address, postal routing information, and optionally printing that evidences that the amount of postage payable for shipping the package has been paid.

Figure 7A:
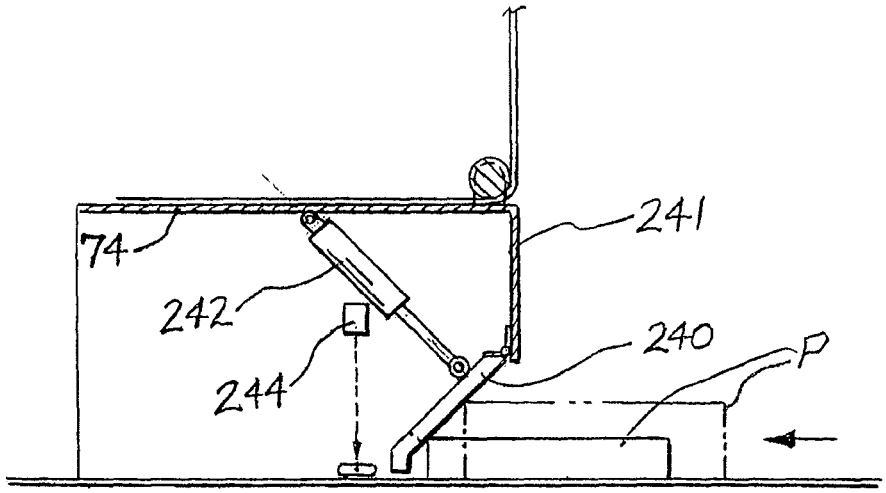
FIG. 7A is a sectioned side view of an infeed gate assembly in accordance with another embodiment of the invention, shown in a first position.
Figure 7B:
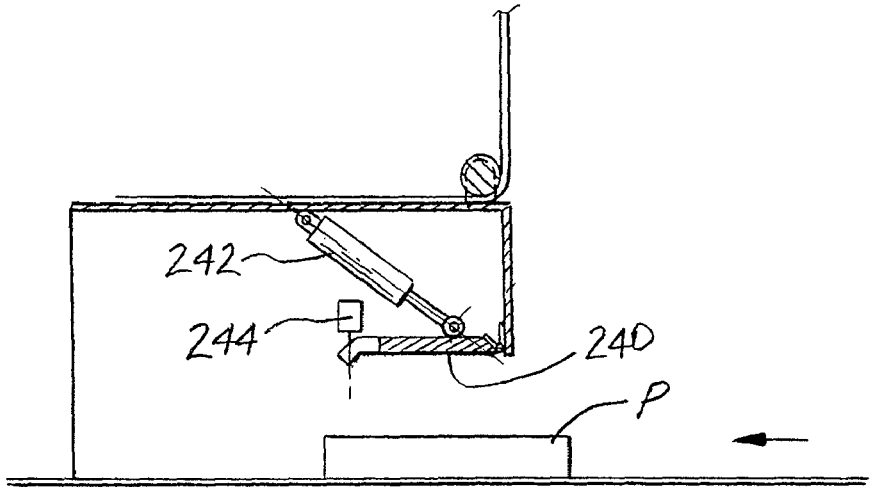
FIG. 7B shows the infeed gate in a second position.
Figure 8:
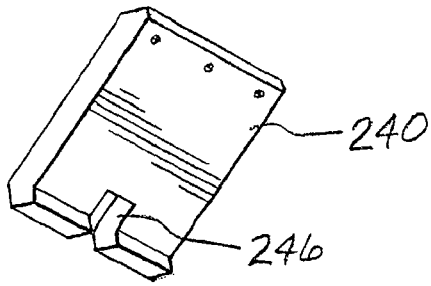
FIG. 8 is a perspective view of the infeed gate of FIGS. 7A and 7B.

An alternative infeed gate assembly in accordance with another embodiment of the invention is depicted in FIGS. 7A, 7B, and 8. The infeed gate assembly includes an infeed gate 240 pivotally connected at its upper edge to a member 241 of the structure that includes the upper web support plate 74. An actuator 242 such as a pneumatic cylinder or the like is connected between the structure and the infeed gate for causing pivotal movement of the gate between a first or blocking position shown in FIG. 7A and a second or unblocking position shown in FIG. 7B. The infeed gate can be positioned at different angular orientations for products of different heights so that a fin length (i.e., the length of packaging material that extends forward of the leading edge of the product on a finished package) can be varied as desired. As seen in FIG. 7A, even for a single oblique angular orientation of the infeed gate 240, the fin length will vary for different height products. In particular, the thicker or higher product P will have a greater fin length than the thinner product because the leading edge of the thicker product will be located farther upstream from the package cutoff device (not shown) compared to the thinner product. In general, it is desirable for the fin length to be greater for thicker products. By varying the angular orientation of the infeed gate in its blocking position as a function of product height, greater control over the fin length can be achieved, if desired. A sensor 244 can be located downstream of the gate for detecting the product as it is conveyed past the gate. The gate can include a slot 246 at its lower edge to prevent blocking the sensor's light of sight when the gate is raised as shown in FIG. 7B. The sensor signal can be used for various purposes. For example, once the product clears the sensor location, the gate can be lowered again in preparation for the next product.

Figure 9A:
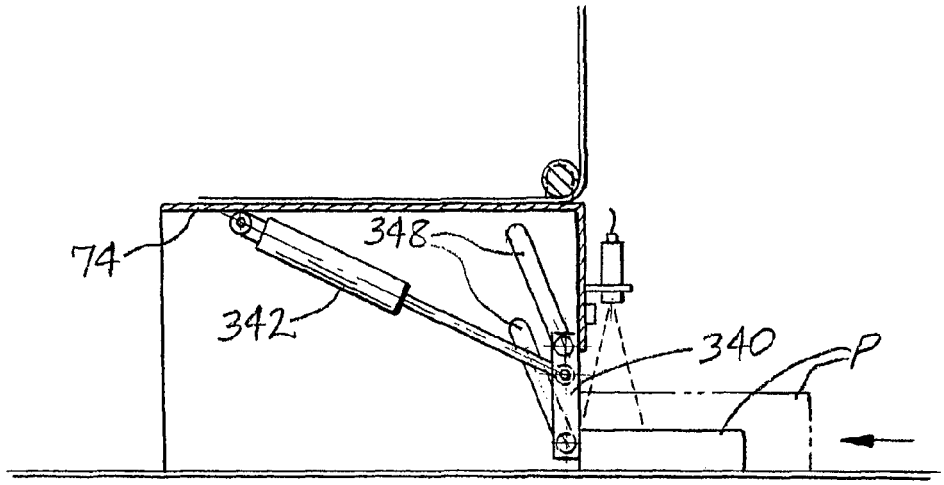
FIG. 9A is a sectioned side view of an infeed gate assembly in accordance with yet another embodiment of the invention, shown in a first position.
Figure 9B:
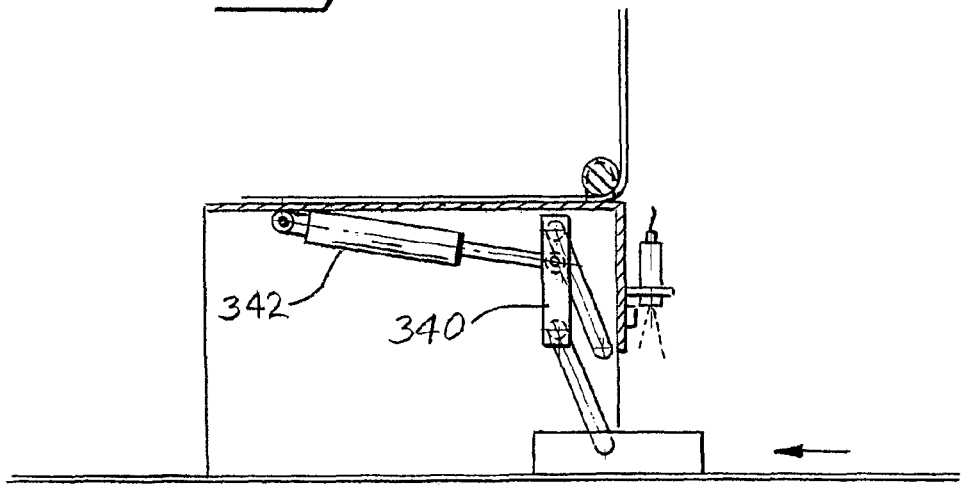
FIG. 9B shows the infeed gate in a second position.

Still another embodiment of an infeed gate assembly is shown in FIGS. 9A and 9B. The infeed gate assembly includes an infeed gate 340 that is mounted to the structure that includes the upper web support plate 74. In particular, the structure defines guide tracks 348 along each of the opposite side edges of the gate, the tracks extending in an inclined direction upwardly and downstream. An actuator 342 is connected between the structure and the gate for moving the gate between a lowered or blocking position (FIG. 9A) and a raised or unblocking position (FIG. 9B). The advantage of this infeed gate assembly is that as the gate is raised, it is also moved downstream away from the product. There is thus a substantially reduced chance that the gate will tend to lift the product along with the gate and thereby inadvertently shift the product's position on the lower web.

Figure 10:
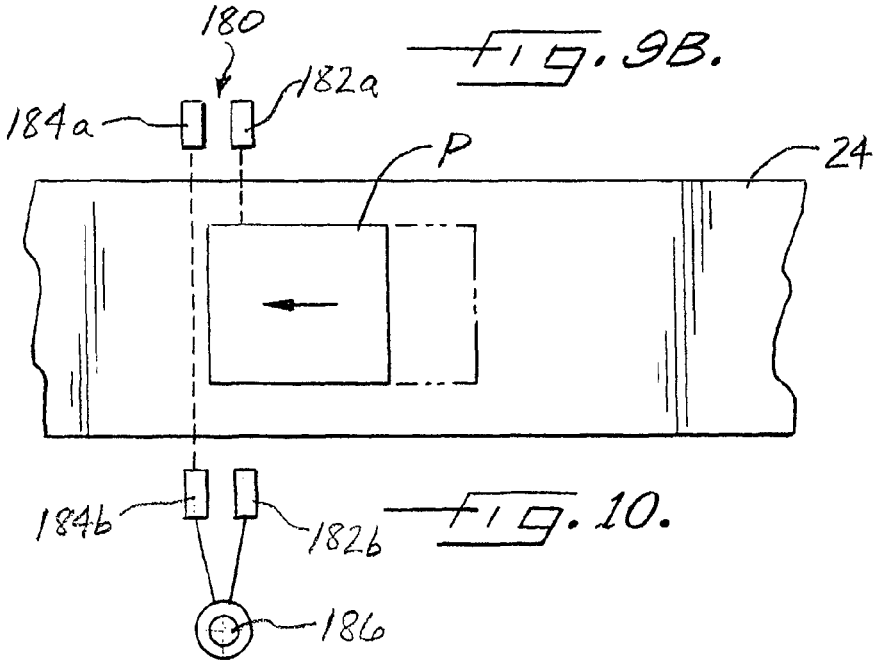
FIG. 10 is a diagrammatic illustration of a detector system for detecting the leading edge of a product placed on the lower web on the infeed bed.

The packaging machine and method described above can be modified in various other ways within the scope of the present invention. For example, the infeed gate 140 can be omitted and instead, a detector system can be used for detecting the leading edge of the product to ensure that the leading edge is in the proper location before the packaging sequence is initiated. As an illustrative example, FIG. 10 is a diagrammatic illustration looking down on the lower web 24 on the infeed bed of the machine. To guide an operator in placing a product P on the lower web in the proper location with respect to the downstream nip rollers so that the label affixed to the upper web and the product are correctly located with respect to each other, a detector system 180 can be used. The detector system can comprise various types and arrangements of detectors operable to detect the leading edge of the product. The illustrated detector system comprises a pair of beam emitters 182*a* and 184*a* located adjacent one longitudinal edge of the lower web 24 and spaced a slight distance apart in the longitudinal direction, and a corresponding pair of beam receivers 182*b* and 184*b* located adjacent the opposite longitudinal edge of the web directly across from the emitters. The emitter 182*a* emits a beam of light in the invisible or visible spectrum, and as long as there is no product on the web blocking the beam's path, the receiver 182*b* receives the beam and produces a signal. Likewise, the receiver 184*b* receives the beam emitted by the emitter 184*a* as long as the product is not blocking the beam and produces a signal. When a product is placed on the lower web upstream of the beams and is slid downstream, at some point, as shown in FIG. 7, the product's leading edge block the beam of the first emitter 182*a* but does not block the beam of the second emitter 184*a*; this causes the first receiver 182*b* to produce no signal (or a signal of a different character), while the second receiver 184*b* produces a signal (or a signal of unchanged character). When this condition is met, it is known that the product's leading edge is in the correct location. If the product is too far downstream and blocks both beams, or is too far upstream and blocks neither beam, it is known based on the receiver signals that the product location is incorrect. The tolerance on leading edge location is a function of the longitudinal spacing of the emitters/receivers, and can be selected as desired. A "go" or "ready" light 186 connected to the detector system is illuminated only when the product is correctly located. When the operator gets the "go" light, the product length can be detected as previously described, and the packaging sequence can proceed.

In accordance with another embodiment of the invention, the detected product length is used in order to center a label on a package. More particularly, in this embodiment, the label applicator 120 tamps the label onto the upper web 22 while the upper web is being advanced toward the nip (i.e., "on-the-fly" tamping). The timing of the tamping is controlled by the controller 160, based on the product length, so that the label is substantially centered on the resulting package in the longitudinal direction. The objective is to have the longitudinal midpoint of the label and the longitudinal midpoint of the product substantially coincide in the longitudinal direction.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An apparatus for packaging products, comprising:

a pair of opposed rollers forming a nip therebetween for receiving a pair of opposing upper and lower webs of flexible packaging material along with a product to be packaged disposed between the webs, facing surfaces of the webs having sealing material for sealing the webs together;

an infeed bed located upstream of the nip, the lower web being supported by the infeed bed such that a product to be packaged can be placed onto the lower web on the infeed bed;

a web drive system operable to advance the upper and lower webs through the apparatus such that the upper and lower webs, along with a product placed on the lower web, are advanced through the nip;

an infeed gate disposed between the infeed bed and the nip, the infeed gate being movable between a blocking position adjacent the lower web such that the infeed gate blocks passage of a product into the nip, and an unblocking position spaced from the lower web such that the infeed gate allows passage of a product into the nip;

an actuator operable to move the infeed gate between the blocking and unblocking positions; and a controller connected to the web drive system and to the actuator, the controller being programmed to coordinate the advancing of the webs with the movement of the infeed gate such that the actuator is caused to move the infeed gate to the blocking position when the webs are stopped and is caused to move the infeed gate to the unblocking position before the webs are advanced.

2. The apparatus of claim 1, wherein the web drive system comprises the rollers and a motor, wherein the rollers are driven by the motor to advance the webs through the nip.

3. The apparatus of claim 2, wherein the controller is programmed to alternately advance the webs and bring the webs to a stop, and to cause the actuator to move the infeed gate to the blocking position when the webs are stopped and to move the infeed gate to the unblocking position before the webs are advanced.

4. The apparatus of claim 1, wherein the infeed gate is arranged such that in the blocking position the gate is in an inclined orientation such that products of different heights abutted against the gate are positioned at different positions in the longitudinal direction along which the products are advanced into the nip.

5. The apparatus of claim 1, wherein the infeed gate is structured and arranged such that as the gate is raised from the blocking position to the unblocking position the gate moves along an inclined path such that the gate moves downstream away from the product.

* * * * *